United States Patent [19]

Evans et al.

[11] 4,036,641

[45] July 19, 1977

[54] CAST IRON

[75] Inventors: Edward Raymond Evans, Birmingham; John Victor Dawson, Stratford-upon-Avon, both of England

[73] Assignee: British Cast Iron Research Association, Birmingham, England

[21] Appl. No.: 650,774

[22] Filed: Jan. 20, 1976

[51] Int. Cl.[2] ..... C22C 33/08

[52] U.S. Cl. ..... 75/130 A; 75/122; 75/123 M; 75/134 S

[58] Field of Search ..... 75/130 A, 122, 123, 75/134 S

[56] References Cited

U.S. PATENT DOCUMENTS

| | | | |
|---|---|---|---|
| 2,757,082 | 7/1956 | Busby | 75/130 A |
| 2,759,812 | 8/1956 | Sawamura | 75/130 A |
| 2,873,188 | 2/1959 | Bieniosek | 75/130 A |
| 3,729,309 | 4/1973 | Kawawa | 75/130 R |

*Primary Examiner*—P. D. Rosenberg

*Attorney, Agent, or Firm*—Scrivener, Parker, Scrivener and Clarke

[57] ABSTRACT

A method of treating molten carbon-containing iron to produce a cast iron with a compacted graphite structure comprising adding to the molten iron in a single step a quantity of an alloy containing silicon, magnesium, titanium and a rare earth, the balance being iron. Preferably, the alloy has the following nominal composition by weight silicon 30–80%, magnesium 3–15%, titanium 3–25%, cerium 0.05–1.0% and the balance iron.

13 Claims, 1 Drawing Figure

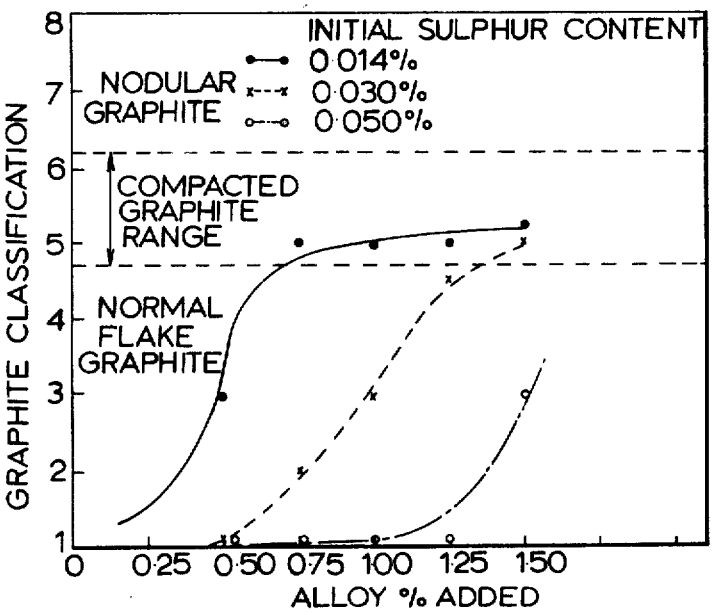
INITIAL SULPHUR CONTENT
0·014%
0·030%
0·050%
NODULAR GRAPHITE
COMPACTED GRAPHITE RANGE
NORMAL FLAKE GRAPHITE
GRAPHITE CLASSIFICATION
8
7
6
5
4
3
2
1
0
0·25
0·50
0·75
1·00
1·25
1·50
ALLOY % ADDED

CAST IRON

This invention relates to the manufacture of cast iron with compacted graphite.

Compacted graphite is a preferred name given to flake graphite which has become rounded, thickened and shortened compared with the normal elongated flakes commonly found in grey cast irons. This modified form of graphite has been known by various names including 'compacted', 'vermicular', 'quasi-flake', 'aggregate flake', 'chunky', 'stubby', 'up-graded', 'semi-nodular' and 'floccular' graphite.

Most cast irons have elongated flake graphite structures and such irons are comparatively weak and brittle, but have good thermal conductivity and resistance to thermal shock. It is know, however, that it is possible to produce cast irons having a nodular graphite structure and these are ductile and comparatively strong, but they have lower thermal conductivity and in some circumstances poorer resistance to thermal shock. Irons with compacted graphite structures combine the high strength and ductility often associated with nodular graphite irons whilst retaining good thermal conductivity and resistance to thermal shock.

Those skilled in the art of iron founding are aware that compacted graphite structures can be produced by alloying with magnesium but the process is difficult to control because of the very narrow range of magnesium contents required to produce the structure (0.015 to 0.02 per cent). Such control is often impracticable and for this reason the process has up to now only had limited commercial use.

Inco and Schelleng (British Patent Specification No. 1 069 058) who refer to the graphite form as 'vermicular graphite', were able to extend the range of permissible magnesium contents by the addition of 0.15 to 0.5 per cent titanium and 0.001 to 0.015 per cent rare earth metal added separately to the molten iron. This quantity of titanium is regarded as high, but was claimed to be necessary to cover a wide range of magnesium contents (0.005 to 0.06 per cent) whilst avoiding the formation of nodular graphite structures.

The usual way of producing compacted graphite irons in which the main added ingredient is magnesium is to add the magnesium as 5 per cent magnesium ferrosilicon containing cerium: the titanium is added either as ferrotitanium or titanium metal in the ladle or as ferrotitanium or titanium-bearing pig iron in the furnace charge. In some cases the cerium is added separately as mischmetall or any other convenient source.

The object of this invention is to provide a method of treating cast iron which can be used to produce compacted graphite structures in the cast iron without the danger of either having too much titanium present in a low magnesium iron or alternatively, of producing nodular graphite because there is insufficient titanium in the case of a high magnesium.

We aim to improve the reliability with which a cast iron is obtained having the required compacted graphite structure despite deviations from the expected values for the amount of metal treated or the sulphur content of the iron. According to the invention this is achieved, instead of by adding the ingredients separately, by a single treatment of the iron with an alloy containing silicon, magnesium, titanium and a rare earth, the balance being iron.

Preferably the alloy has the following nominal compositions by weight:

Silicon : 30-80%
Magnesium : 3-15%
Titanium : 3-25%
Cerium : 0.05-1.0%
Balance : iron The ratio of Mg:Ti is preferably between 1:1 and 1:2 and the ratio of Mg:Ce may be between 50:1 and 1:2 but is preferably between 50:1 and 10:1.

The preferred composition is:

Silicon : 40-60%
Magnesium : 4-6%
Titanium : 5-8%
Cerium : 0.1-0.5%
Balance : iron Alloys of the kind embodied in this invention can be produced by a variety of methods well-known for the production of ferroalloys based upon ferrosilicon. The titanium and cerium (and rare earths, if any) may be incorporated in the alloy by reduction of minerals containing these elements during the smelting process for the ferroalloys. Alternatively, they may be incorporated by adding metallic master alloys such as mischmetall and titanium metal to the molten ferrosilicon prior to casting into chilled moulds. Another alternative is to reduce the titanium and cerium (and rare earths, if any) from suitable minerals directly into the molten ferrosilicon alloy. The proportion of rare earths which may be present partly replacing the cerium will depend upon the method of producing the alloy, since the cheapest available sources of cerium will be used and will vary according to whether they are mineral or master alloy in origin.

The addition of such an alloy in a single treatment ensures that the quantity of titanium added increases automatically with an increase in the quantity of magnesium added so that there is always sufficient titanium present to inhibit the formation of nodular graphite which over-treatmemt with magnesium might otherwise produce. There is therefore a certain latitude in the quantity of alloy added which makes process control less critical, for example, variations in the quantity of iron treated can be tolerated, and which thus makes the process more practical for use in commercial foundries.

The alloy will not give titanium contents as high as those specified in the above-mentioned British Patent Specification No. 1 069 058 and recent work has shown that when the magnesium content is in the range 0.01 to 0.035 per cent, the titanium content need only be in the range 0.06 to 0.15 per cent, and only a trace of cerium is needed.

Preferably the iron is inoculated, for example with ferrosilicon, after the addition of the alloy.

An alloy containing by weight 44.5 per cent silicon, 4.9 per cent magnesium, 6.5 per cent titanium and 0.3 per cent cerium was prepared by melting cerium bearing magnesium-ferrosilicon and adding 7.5 per cent titanium by weight and 1 per cent magnesium to replace any loss of this element during preparation of the alloy. The melt was cast into chill moulds and the solidified alloy subsequently crushed and graded. Graded alloy ¼ to 1 inch in size was used in the following examples producing test bars, although coarser grades can be used for treating larger quantities of iron in a commercial foundry.

EXAMPLE 1

Iron of high purity was melted in an electric furnace and its composition adjusted to produce an iron of approximately eutectic composition. Four taps were taken from the melt and a different quantity of the alloy (i.e. 0.80%, 1.33% and 1.67%) was added to each by tapping the iron onto the alloy in a casting ladle. Silicon metal was added to the four taps as required to maintain similar final silicon contents. Each tap was inoculated with 0.25 per cent ferrosilicon prior to pouring.

4 inch diameter test bars were cast from each tap. Each bar was ultrasonically tested to give a ready indication of its graphite structure and a specimen was cut from midway between the edge and centre of each bar and its microstructure examined visually to determine the nature of the graphite structure and classify it. The classification used consists of numbers ranging from 1 to 8, classifications 1 to 4 being flake forms ranging from coarse to fine, classification 5 being fully compacted graphite, classification 6 being mainly compacted graphite with a few nodules but nevertheless still acceptable as compacted graphite, and classifications 7 and 8 being less acceptable as compacted graphite because of the presence of an increasing proportion of nodules. The results obtained and the composition of the respective test bars were as follows:

| Alloy added % | C% | Si% | Mn% | S% | P% | Ti% | Mg% | Ultrasonic vel. km/s | Graphite |
|---|---|---|---|---|---|---|---|---|---|
| 0.80 | 3.75 | 2.11 | 0.18 | 0.016 | 0.01 | 0.060 | 0.017 | 5.08 | 6 |
| 1.00 | | | | 0.015 | | 0.084 | 0.020 | 5.03 | 6 |
| 1.33 | | | | 0.020 | | 0.092 | 0.022 | 5.02 | 6 |
| 1.67 | | | | 0.019 | | 0.129 | 0.035 | 5.02 | 6 |

The similarity of the ultrasonic velocity figures for all of the test bars reflects the similarity in their graphite structures which can be identified as compacted graphite corresponding to a known ultrasonic velocity range of about 4.75 – 5.12 Km/second in 4 inch diameter test bars. The visual examination confirmed these results.

Thus, alloy additions ranging from 0.8% to 1.67% have the desired effect of producing compacted graphite in the treated iron.

EXAMPLE 2

Iron based on recarbonized steel scrap but of similar composition to that treated in Example 1 was melted and two taps were taken from the melt, each being treated with a different amount of the alloy (i.e. 1.80% and 1.25%) by tapping onto the alloy in a casting ladle.

12 inch diameter by 16 inch test bars were cast and examined ultrasonically and visually as to their graphite structure as in Example 1. The results, and also the composition of the test bars were as follows:

| Alloy added % | C% | Si% | Mn% | S% | P% | Ti% | Mg% | Ultrasonic vel. km/s | Graphite class |
|---|---|---|---|---|---|---|---|---|---|
| 1.80 | 3.76 | 1.64 | 0.22 | 0.010 | 0.01 | 0.074 | 0.027 | 4.98 | 5 |
| 1.25 | | | | 0.019 | | 0.052 | 0.018 | 4.70 | 5 |

These results indicate that the desired fully compacted graphite structure was produced in the test bars. The lower ultrasonic velocity corresponds to the coarser structure of the graphite in these 12 inch diameter test bars as compared with the 4 inch diameter test bars in Example 1.

EXAMPLE 3

The alloy used in this example contained by weight 44.0 per cent silicon, 5.2 per cent magnesium, 6.9 per cent titanium and 0.3 per cent cerium, this being prepared as described above in relation to Examples 1 and 2.

A melt of high-purity pig iron with an initial sulphur content of 0.014% was treated, a set of five taps being taken from the melt and each being treated with a different amount of the alloy (i.e. 0.50%, 0.73%, 1.00%, 1.23% and 1.50%) by tapping onto the alloy in a casting ladle. Each tap was inoculated with 0.25% ferrosilicon before being used to cast a 4 inch diameter and a 1.2 inch diameter test bar.

The 4 inch diameter test bars were examined ultrasonically and visually as described above in Example 1 and the 1.2 inch diameter bars were only examined visually. The results, together with composition of the test bars, were as follows:

| Alloy added % | C% | Si% | Mn% | S% | P% | Ti% | Mg% | Ultrasonic vel. km/s | Graphite class 4 in. | Graphite class 1.2 in. |
|---|---|---|---|---|---|---|---|---|---|---|
| 0 | 3.76 | 1.68 | 0.24 | 0.014 | 0.01 | <0.01 | — | — | — | — |
| 0.50 | | | | 0.013 | | 0.035 | 0.009 | 4.00 | 3 | 2–3 |
| 0.73 | | | | 0.014 | | 0.054 | 0.018 | 4.97 | 5 | 5 |
| 1.00 | | | | 0.012 | | 0.066 | 0.021 | 5.00 | 5 | 5 |
| 1.23 | | | | 0.012 | | 0.074 | 0.024 | 5.12 | 5 | 5–6 |
| 1.50 | | | | 0.012 | | 0.095 | 0.031 | 5.12 | 5 | 5–6 |

The same melt was then treated so as to increase its sulphur content to 0.030% and another five taps were taken and each treated with a different amount of the alloy as described above, inoculated with 0.25% ferrosilicon and cast to form a 4 and 1.2 inch diameter test bar which were examined as to their graphite structure. The results were as follows:

| Alloy added % | C% | Si% | Mn% | S% | P% | Ti% | Mg% | Ultra-sonic vel. km/s | Graphite class 4 in. | Graphite class 1.2 in. |
|---|---|---|---|---|---|---|---|---|---|---|
| 0 | 3.72 | 1.67 | 0.24 | 0.03 | 0.01 | <0.01 | — | — | — | — |
| 0.50 | | | | 0.025 | | 0.036 | 0.009 | 3.44 | 1 | 1 |
| 0.73 | | | | 0.025 | | 0.054 | 0.016 | 3.47 | 2 | 2 |
| 1.00 | | | | 0.025 | | 0.062 | 0.018 | 4.06 | 3 | 3 |
| 1.23 | | | | 0.025 | | 0.077 | 0.019 | 4.86 | 4–5 | 3–4 |
| 1.50 | | | | 0.025 | | 0.094 | 0.022 | 4.94 | 5 | 5 |

Finally, the melt with increased sulphur content was treated again to increase its sulphur content to 0.050% and another five taps were taken and each treated with a different amount of the alloy as described above, inoculated with 0.25% ferrosilicon and used to form 4 inch and 1.2 inch diameter test bars which were examined as to their graphite structure. The results and composition of the test bars were as follows:

| Alloy added % | C% | Si% | Mn% | S% | P% | Ti% | Mg% | Ultra-sonic vel. km/s | Graphite class 4 in. | Graphite class 1.2 in. |
|---|---|---|---|---|---|---|---|---|---|---|
| 0 | 3.71 | 1.69 | 0.24 | 0.050 | 0.01 | <0.01 | | | | |
| 0.5 | | | | 0.047 | | 0.034 | 0.009 | 3.43 | 1 | 1 |
| 0.73 | | | | 0.047 | | 0.049 | 0.015 | 3.55 | 1 | 1 |
| 1.00 | | | | 0.041 | | 0.060 | 0.017 | 3.81 | 1 | 3 |
| 1.23 | | | | 0.042 | | 0.074 | 0.020 | 3.96 | 1 | 3 |
| 1.50 | | | | 0.032 | | 0.091 | 0.021 | 3.83 | 3 | 3 |

The results obtained using the three series of differing sulphur content can be presented in graphic form as shown in the accompanying drawing, each curve 1, 2, 3 being a plot of the graphite classification against the quantity of added alloy for a particular sulphur content 0.014%, 0.030%, 0.050%, respectively. The graph uses the results obtained from examination of the 4 inch diameter test bars, not the 1.2 inch diameter test bars.

These results show that an increasing quantity of alloy is required with increasing sulphur content to produce compacted graphite. They also show that compacted graphite can be obtained with additions of between 1.25 per cent and 1.5 per cent with base sulphur contents of 0.014 per cent and 0.03 per cent. Therefore, if it is only known that the sulphur content of the iron to be treated is below 0.03 per cent, the quantity of alloy to be added can be calculated on the assumption that the sulphur content is 0.03 per cent. If the sulphur content in fact lies below 0.03 per cent, the risk of over-treatment (excess magnesium) to give nodular graphite will be minimised by the simultaneous addition of titanium which the alloy provides.

Irons containing more than 0.03 per cent sulphur are preferably desulphurised prior to treatment with the alloy rather than treating the irons with larger quantities of the alloy.

It is known that the effect of cerium in producing compacted graphite is also achieved by replacing a proportion of the cerium by other rare earth elements or a mixture of other rare earth elements. Where an amount of cerium is mentioned, in the Examples above and in the claims, it is to be understood that up to approximately half of this amount may be replaced by other rare earth elements, or indeed all the cerium could be replaced by other rare earth although generally it is more economical to use cerium.

We claim:

1. A method of treating molten carbon-containing iron to produce a cast iron with a compacted graphite structure comprising adding to the molten iron in a single step a quantity of an alloy containing silicon, magnesium, titanium and a rare earth, the balance being iron.

2. A method according to claim 1 in which the alloy has the following nominal composition by weight:
Silicon : 30-80%
Magnesium : 3-15%
Titanium : 3-25%
Cerium : 0.05 -1.0%
Balance : Iron 3. A method according to claim 2 in which the ratio of magnesium to titanium in the alloy is between 1:1 and 1:2 by weight.

4. A method according to claim 2 in which the ratio of magnesium to cerium is between 50:1 and 1:2 by weight.

5. A method according to claim 4 in which the ratio of magnesium to cerium is between 50:1 and 10:1 by weight.

6. A method according to claim 2 in which the alloy has the following nominal composition by weight:
Silicon : 40-60%
Magnesium : 4-6%
Titanium : 5-8%
Cerium : 0.1-0.5%
Balance : Iron 7. A method according to claim 1 in which the alloy is added to the extent of 0.8% to 1.8% by weight of the molten iron.

8. A method according to claim 1 in which, after the addition of the alloy, the iron is treated with an inoculant.

9. A method according to claim 8 in which the inoculant is ferrosilicon.

10. An alloy for use in the method according to claim 2 the alloy being of the following nominal composition by weight:
Silicon : 30-80%
Magnesium : 3-15%
Titanium : 3-25%
Cerium : 0.05-1.0%
Balance : Iron 11. An alloy for use in the method according to claim 3 the alloy being of the following nominal composition by weight:

Silicon : 40-60%
Magnesium : 4-6%
Titanium : 5-8%
Cerium : 0.1-0.5%
Balance : Iron 12. A method according to claim 7 in which the amount of the alloy added is such as to produce a final titanium content in the treated iron of less than 0.15% by weight.

13. A method according to claim 12 in which the amount of the alloy added is such as to produce a final titanium content in the treated iron of between 0.06 and 0.15% by weight.

* * * * *